United States Patent [19]

Richichi et al.

[11] Patent Number: 5,004,128

[45] Date of Patent: Apr. 2, 1991

[54] FLEXI-NOZZLE

[76] Inventors: Thomas Richichi; Paul Richichi, both of 1462 Coolidge St., North Bellmore, N.Y. 11710

[21] Appl. No.: 307,047

[22] Filed: Feb. 7, 1989

[51] Int. Cl.[5] ..... B67D 3/00

[52] U.S. Cl. ..... 222/527; 222/325

[58] Field of Search ..... 222/527, 526, 327, 325, 222/326

[56] References Cited

U.S. PATENT DOCUMENTS

| | | | |
|---|---|---|---|
| 1,296,045 | 3/1919 | Campbell | 222/527 |
| 2,833,444 | 5/1958 | Sherbondy | 222/326 |
| 3,058,632 | 10/1962 | Stremmel | 222/327 |
| 3,211,347 | 10/1965 | Phillips, Jr. | 222/327 |
| 3,658,213 | 4/1972 | Plumer | 222/327 |
| 4,921,147 | 5/1990 | Poirier | 222/527 |

*Primary Examiner*—Robert P. Olszewski
*Assistant Examiner*—Kenneth Noland
*Attorney, Agent, or Firm*—Terry M. Gernstein

[57] ABSTRACT

A sealant material dispenser is monolithic and includes a dispensing section that forms a one-piece construction. The dispensing section includes a flexible section that is adapted to be bent with respect to the body of the dispenser so sealant material can be dispensed into hard-to-reach locations and, once bent, the flexible section will retain the bend during the dispensing operation. The dispensing section also includes a conical nozzle that can be cut to adjust the size of the bead of material being dispensed.

5 Claims, 2 Drawing Sheets

FLEXI-NOZZLE

TECHNICAL FIELD OF THE INVENTION

The present invention relates to the general art of containers, and to the particular field of containers having dispensers associated therewith. Specifically, the present invention relates to sealant-type dispensing containers.

BACKGROUND OF THE INVENTION

In the use of materials, such as caulking compound, adhesive or sealer, it is often necessary to dispense such materials into hard-to-reach locations, such as behind plumbing fixtures and the like. For the sake of convenience, all such materials will be referred to hereinafter as sealant materials, and it is understood that such term is intended to include all forms of caulking, adhesives, sealers, plugging compounds, waterproofing compounds and the like.

In the past, such materials have been dispensed from tubes positioned in caulkers directly onto the area being sealed. However, there are many situations which have areas that are not reachable by such direct application of material. Those skilled in the plumbing and electrical arts are well aware of such inconvenient situations.

Accordingly, there is a need for a device which will permit a user to dispense sealant materials into hard-to-reach locations.

As is also well known to those skilled in the art, not all jobs require the same size of sealant material bead to be used. For example, some jobs require the bead of sealant to be as small as ⅛ or smaller in width; whereas, some jobs may require such bead to be as much as 5/16" or larger in width. In the past, such large jobs required the user to duplicate the dispensing process several times. Such duplication of effort exacerbates any difficulties associated with the dispensing process itself.

Accordingly, there is still a further need for a device which not only dispenses sealant materials into hard-to-reach locations, but does so in a manner that permits the bead size to be easily varied.

OBJECTS OF THE INVENTION

It is a main object of the present invention to provide a sealant dispenser which is amenable for use in hard-to-reach locations.

It is another object of the present invention to provide a sealant dispenser which is amenable for use in hard-to-reach locations and which is further amenable to easily changing the size of a bead of material being dispensed.

SUMMARY OF THE INVENTION

These, and other, objects are accomplished bY a monolithic container that includes a dispensing section having a flexible portion connecting a severable nozzle to the main body of the container. The flexible portion is designed to be flexed into any suitable angle with respect to the main body and to hold such flexed orientation when sealant material is being forced through that nozzle from the main body. The nozzle includes a conical portion that converges toward the exit plane of that nozzle and can be cut transversely of the longitudinal centerline at various locations along such longitudinal centerline to change the size of the exit port of the nozzle.

In this manner, the sealant material can be dispensed in suitable amounts to difficult-to-reach locations, such as behind plumbing fixtures, or the like, by simply cutting the nozzle to the desired exit port size, bending the flexible section as necessary, locating the sized exit port in the desired location and operating the calker which is used in association with the monolithic container. The monolithic nature of the container ensures that even under severely bent conditions, the container will not leak or separate during the dispensing operation.

DETAILED DESCRIPTION OF THE PREFERRED EMBODIMENT OF THE INVENTION

Figure 1:
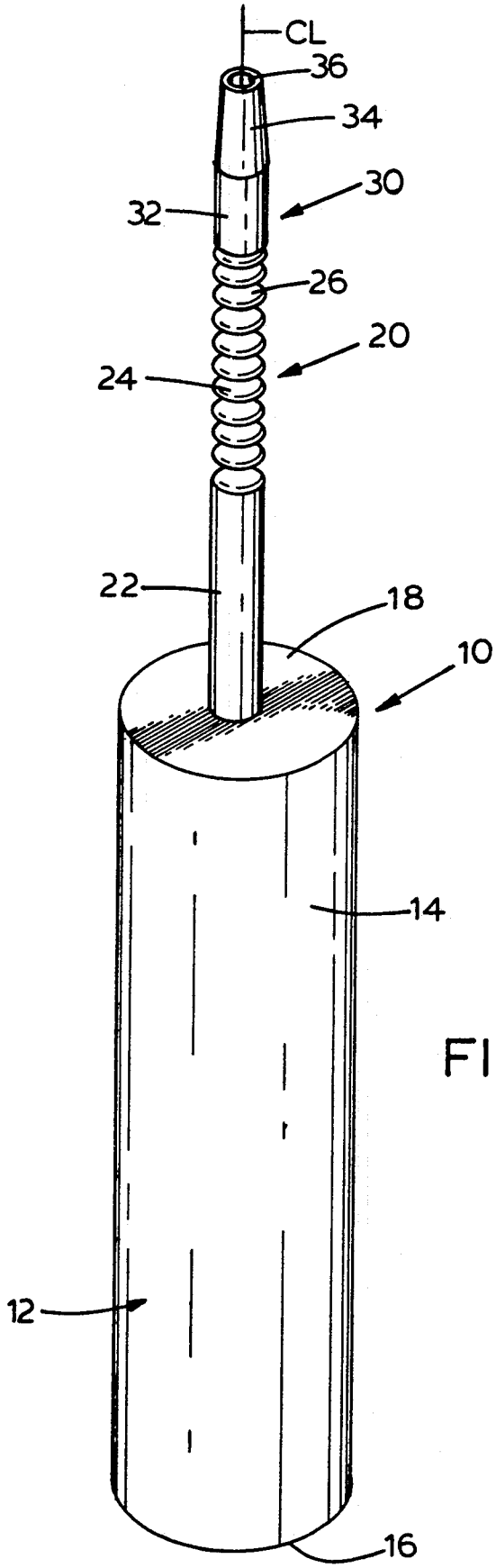
FIG. 1 is a perspective of a monolithic container embodying the present invention.

Shown in FIG. 1 is a single use sealant-type material container and dispenser 10 of the present invention. The overall container and dispenser 10 is monolithic so that structural integrity is ensured. Thus, while the various parts and sections of the overall container will be described separately, it is to be understood that the overall device is monolithic and one piece.

The device 10 includes a body 12 having a flexible, collapsible wall 14 connecting a rear end 16 to a forward end 18. The flexible nature of the wall and the ends of the body enable such body to be used in a calker in the usual manner. The rear end of the body can be movable if desired as will occur to those skilled in this art, and the interior of the body is hollow to contain the sealant material.

Attached to the forward end is a monolithic dispensing means 20 that is connected to the interior of the body 14 in a manner that permits the dispensing of the sealant material.

The dispensing means 20 includes a cylindrical non-deformable base section 22 fixed to the forward end 18 at one end and having a flexible connecting section 24 at the other end. The base section 22 is not deformable so that the flexible connecting section will hold a bent condition. If the flexible connecting section were connected directly to the body 14, it may not be likely to retain a bent configuration.

Figure 2:
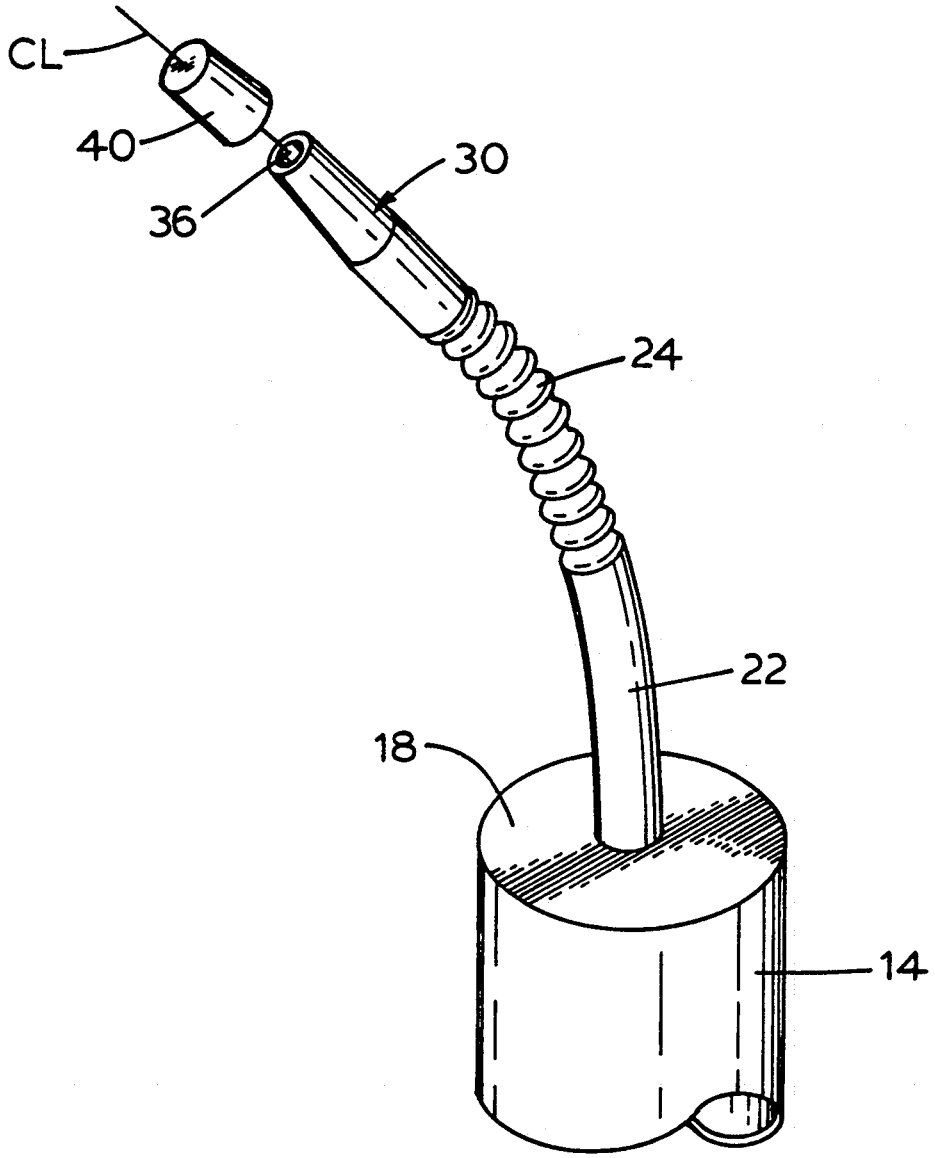
FIG. 2 is a perspective of the dispensing section of the monolithic container of the present invention.

The flexible connecting section 24 is formed of a material that is similar to that used as sheathing on electrical conduits that are used out-of-doors. The connecting section 24 includes a multiplicity of accordion-like portions, such as portion 26, that are arranged so that the connecting section is ductile enough to be angled from the FIG. 1 orientation with respect to the body 14 to a selected angle, such as shown in FIG. 2, and will remain in such angled orientation even when highly viscous sealant material is forced through such section. The ductility required and the type of material required to fulfill this requirement will be evident to those skilled in the art based on the teaching of the present disclosure and based on teaching such as found in texts such as "The Making, Shaping and Treating of Steel", 10th Edition, by the United States Steel Corp and published by the Association of Iron and Steel Engineers in 1985 (see in particular pages 1389, 1402–1408, and pages 1441–1442, the disclosure of which is incorporated herein by reference), and the Marks' Standard Handbook for Mechanical Engineers, seventh edition published by the Mc-Graw-Hill Book Company in 1967 (see in particular Chapter 5, the disclosure of which is incorporated herein by reference).

The connecting section 24 has a central bore therethrough that connects to that bore in the base section 22 to conduct sealant material therethrough.

The dispensing means 20 further includes a nozzle section 30 connected to the connecting section 24. The nozzle section includes a cylindrical entrance section 32 and a conical dispensing section 34. The nozzle section is formed of a plastic type material that can be cut by hand pressure applied to a scissors or a carpenter's knife, or the like. The nozzle section includes a longitudinal centerline CL, and the conical section 34 converges from the entrance section toward that longitudinal centerline to an exit plane containing an exit port 36. The nozzle section is connected to the entrance portion and to the flexible connecting section to pass sealant material out of the dispensing means onto the selected area of application.

In the preferred embodiment, the section 22 is approximately ⅜ths of the total length of the dispensing means 20 and the nozzle section 30 is approximately ¼th of the total length of the dispensing means, with the connecting section 24 forming the remaining ⅜ths of the total length. These fractions of the total length are selected so that any bend in the connecting section will be retained as the viscous sealant material is forced out of the dispensing means. For example, if the total length of the dispensing means 20 is 4", the section 22 is 1½", the connecting section 24 is 1½" and the nozzle section 30 is 1" in length. If the sections 22 and 30 are too short with respect to the section 24, the flexible nature of the connecting section may influence the dispensing means to move from a bent configuration; however, if the sections 22 and 30 are too long with respect to the flexible section 24, the flexible section may not have enough flexibility to be bent sufficiently to fulfill all of the requirements of the device 10, or the overall dispensing means 20 may be too long and thus be wasteful of material and not be easily stored and/or used.

Cutting the nozzle conical section in a direction transverse to the longitudinal centerline will enlarge the exit port 36 due to the converging nature of the section 34 so that the size of the bead of material can be adjusted. The device 10 is intended to be a single-use device, and thus deforming the nozzle section by cutting need not be reversible. The angle of dispensing can be further adjusted by the angle of the cut made in the nozzle conical section. The angle can be essentially perpendicular to the longitudinal centerline CL or can be at an angle with respect to such centerline. The length of the nozzle section is also selected to provide sufficient length to that section to permit cutting as above described.

A single bend is shown in FIG. 2; however, it is noted that the connecting section can be bent in several directions to accommodate very difficult to reach locations.

A cap, such as cap 40 indicated in FIG. 2 can also be included for shipping and storage purposes if suitable.

It is to be understood that while certain forms of the present invention have been illustrated and described herein, it is not to be limited to the specific forms or arrangement of parts described and shown.

What is claimed is:

1. A single-use monolithic container for sealant-type materials comprising:

(A) a monolithic container body having a rear end and a forward end, said container body storing sealant-type material and having at least a portion thereof adapted to be moved by a calker-type element to force the sealant material out of the body;

(B) a monolithic dispensing means on said body forward end and being monolithic with said body and forming a one-piece construction therewith, said dispensing means including an elongate body having a body overall length and including (1) a non-deformable base section attached at a rear end thereof to said container body forward end to extend outwardly of said container body forward end for ⅜ of the body overall length and having a forward end, (2) a nozzle section on said elongate body forward end, said nozzle section extending for ¼ of the body overall length and including (a) a cylindrical entrance section and (b) a conical dispensing section on said cylindrical entrance section, said conical dispensing section having an exit port and being shaped to converge from said entrance section towards said exit port, (c) a flexible connecting section connecting said base section to said nozzle section and extending for ⅜ of the body overall length, said connecting section including a multiplicity of accordion folded portions, said connecting section being formed of flexible material which is ductile enough to permit said connecting section to be bent with respect to said container body and stiff enough to permit a bent connecting section to retain a bent condition as material from said container body is forced from said container body through said dispensing means, and (3) a material passage in said dispensing means connecting the interior of said dispensing means to the interior of said container body for conducting sealant material from said container body to and through said dispensing means.

2. The container defined in claim 1 wherein said connecting section is formed of steel.

3. The container defined in claim 2 wherein said conical dispensing section is elongate.

4. The container defined in claim 3 wherein said conical dispensing section is formed of plastic material which can be cut by hand pressure applied to a cutting instrument, such as scissors, to alter the size of the material being dispensed from said dispensing means.

5. A single-use monolithic container for sealant-type materials comprising:

(A) a monolithic, one-piece unit which includes (1) a container body section having a rear end and a forward end, said container body section storing sealant-type material and having at least a portion thereof adapted to be moved by a calker-type element to force the sealant-type material out of the body section;

(2) a monolithic dispensing section located on said body forward end and having a body overall length and including (a) a non-deformable base section attached at a rear end thereof to said container body forward end to extend outwardly of said container body forward end for ⅜ of the body overall length, said base section having a forward end, (b) a nozzle section on said elongate body forward end, said nozzle section extending for $\frac{1}{4}$ of the body overall length and including
(i) a cylindrical entrance section and
(ii) a conical dispensing section on said cylindrical entrance section, said conical dispensing section having an exit port and being shaped to converge from said entrance section towards said exit port, (c) a flexible connecting section between said base section and said nozzle section and extending for $\frac{3}{8}$ of the body overall length, said connecting section including a multiplicity of accordion folded portions, said connecting section being formed of flexible material which is ductile enough to permit said connecting section to be bent with respect to said container body and stiff enough to permit a bent connecting section to retain a bent condition as material from said container body is forced from said container body through said dispensing means, and (3) a material passage in said dispensing means connecting the interior of said dispensing means to the interior of said container body for conducting sealant material from said container body to and through said dispensing means.

* * * * *